US006845730B2

(12) United States Patent
Cardarelli

(10) Patent No.: US 6,845,730 B2
(45) Date of Patent: Jan. 25, 2005

(54) FLAG MOUNTING DEVICE

(76) Inventor: Venanzio Cardarelli, 20 N. Triangle Dr., Plymouth, MA (US) 02360

( * ) Notice: Subject to any disclaimer, the term of this patent is extended or adjusted under 35 U.S.C. 154(b) by 0 days.

(21) Appl. No.: 10/629,476

(22) Filed: Jul. 30, 2003

(65) Prior Publication Data

US 2004/0031433 A1 Feb. 19, 2004

Related U.S. Application Data

(60) Provisional application No. 60/404,280, filed on Aug. 19, 2002.

(51) Int. Cl.[7] ..... G09F 17/00
(52) U.S. Cl. ..... 116/173; 116/174
(58) Field of Search ..... 116/173, 174

(56) References Cited

U.S. PATENT DOCUMENTS

| | | | | | |
|---|---|---|---|---|---|
| 756,989 | A | | 4/1904 | Suhr | 116/174 |
| 1,236,417 | A | | 8/1917 | Finn | 116/174 |
| 1,306,915 | A | | 6/1919 | Klamroth | 116/174 |
| 1,678,529 | A | | 7/1928 | Peters | 116/174 |
| 2,368,783 | A | | 2/1945 | Schillinger | 116/174 |
| 2,672,118 | A | | 3/1954 | Martin | 116/174 |
| 2,711,712 | A | | 6/1955 | Reed, Jr. | 116/174 |
| 2,799,240 | A | | 7/1957 | Andrews | 116/174 |
| 3,706,297 | A | * | 12/1972 | Voorhees | 116/174 |
| 4,452,167 | A | | 6/1984 | Burroughs | 116/173 |
| 5,279,250 | A | | 1/1994 | Palermo et al. | 116/174 |
| 5,291,849 | A | * | 3/1994 | Zeitler | 116/174 |
| 5,363,607 | A | | 11/1994 | Turturro | 52/40 |
| 5,375,555 | A | * | 12/1994 | Dolan | 116/174 |
| 5,495,821 | A | * | 3/1996 | Brewer | 116/174 |
| 5,568,784 | A | | 10/1996 | Willis et al. | 116/173 |
| 5,603,389 | A | * | 2/1997 | Zemon | 116/174 |
| 5,809,930 | A | | 9/1998 | Brooks | 116/174 |
| 5,904,116 | A | * | 5/1999 | Wyner et al. | 116/173 |
| 5,943,980 | A | * | 8/1999 | Huang | 116/174 |
| 5,975,009 | A | | 11/1999 | Nihra et al. | 116/173 |
| 6,276,083 | B1 | * | 8/2001 | Ross | 116/173 |
| 6,389,659 | B1 | * | 5/2002 | Jacobs | 116/173 |
| 6,584,928 | B2 | * | 7/2003 | Kinahan | 116/174 |
| 2002/0178997 | A1 | * | 12/2002 | Tsui-Hua | 116/174 |
| 2003/0192467 | A1 | * | 10/2003 | Paris | 116/173 |

* cited by examiner

*Primary Examiner*—Diego Gutierrez
*Assistant Examiner*—Tania Courson
(74) *Attorney, Agent, or Firm*—D. Michael Burns

(57) ABSTRACT

A device for preventing a flag from wrapping around a flagpole. The flag is mounted to at least one device that is positioned on the flagpole. The flag has one edge affixed to a rod, which is therein connected on opposing ends to rotatory of the invention. The rotatory have a capability of 360 degrees of free rotation. Each rotator is positioned and supported on the flagpole by opposing stabilizers, which support and position the rotators in a suspended relationship with the flagpole, thereby allowing them to rotate while maintaining a proper flying flag.

7 Claims, 5 Drawing Sheets

FLAG MOUNTING DEVICE

CROSS-REFERENCE TO RELATED APPLICATIONS

This application is based on Provisional Patent Application Ser. No. 60/404,280, filed on Aug. 19, 2002.

FIELD OF THE INVENTION

The invention relates generally to a flag support and mounting device, and more specifically, to a device for preventing a flag from wrapping and becoming entangled around a flagpole. The device allows for free rotation about the flagpole.

DESCRIPTION OF THE PRIOR ART

It is well known that flags, when blown by variable gusty winds, will occasionally wrap themselves around the flagpole to which they are mounted. Thus entangled, the flag cannot be unfurled by the next breeze and is thus rendered relatively useless. This problem is particularly acute with flagpoles that extend at an angle with the vertical.

The use of flag unfurlers is known in the prior art. More specifically, flag unfurlers heretofore devised and utilized for the purpose of maintaining a flag in an untangled state, are known to consist basically of familiar, expected and obvious structural configurations. This is notwithstanding the myriad of designs encompassed by the crowded prior art which have been developed for the fulfillment of countless objectives and requirements.

U.S. Pat. No. 5,279,250 to Palermo, Jr. et al. discloses an automatic flag unfurler.

U.S. Pat. No. 4,452,167 issued to Burroughs teaches of a device for preventing a flag from wrapping around a flagpole.

U.S. Pat. No. 2,368,783 to Schillinger, U.S. Pat. No. 2,799,240 to Andrews, U.S. Pat. No. 1,306,915 to Klamroth, U.S. Pat. No. 3,706,297 to Voorhees, and U.S. Pat. No. 5,809,930 issued to Brooks, all discuss means and devices to prevent fowling of the flags about the pole and also to allow the flags to freely rotate about the flagpole.

Therefore, it can be appreciated that there exists a continuing need for new and improved flagpole rotation device that can be used for allowing a flag to freely rotate around a flagpole following the wind direction. In this regard, the present invention substantially fulfills this need.

SUMMARY OF THE INVENTION

Therefore, in view of the above, it is an object of the present invention to provide a device that will minimize the possibility of a flag becoming entangled with a flagpole while at the same time maintaining a natural appearance of the flag.

The present invention provides for a mounting device comprising of a rotator and a stabilizer to be rotationally mounted to a flagpole with the rotator having a portion for holding the flag.

An embodiment of the invention utilizes a rod passing through a sleeve in the flag, and then mounting the device to the sleeve/rod in such a manner that the flag will fly freely yet not become furled.

Another embodiment of the invention has the rotator having means to attach clips to the rod/flag sleeve whereby the flag will not be subject to unnecessary sagging.

Another embodiment of the invention provides for the rotator to have friction-fitting attachment means for fastening the flag directly to the rotator.

Another object of the invention is to incorporate plastic strips and/or plastic segments to the flag for the purposes of adding weight which functions in straightening the flag and also preventing furling.

DETAILED DESCRIPTION OF THE PREFERRED EMBODIMENTS

Figure 1:
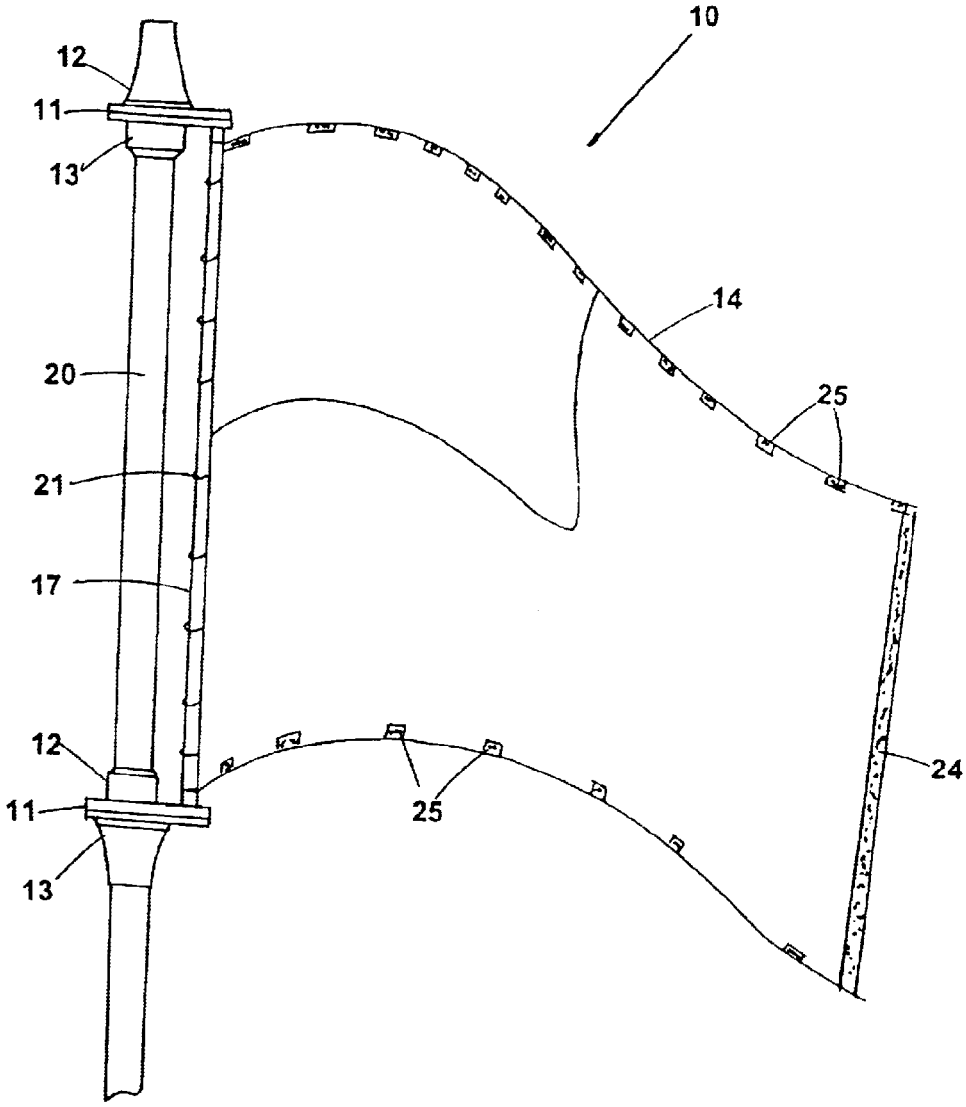
FIG. 1 is a front elevation view of a flag mounted on a flagpole in accordance with the present invention.
Figure 3:
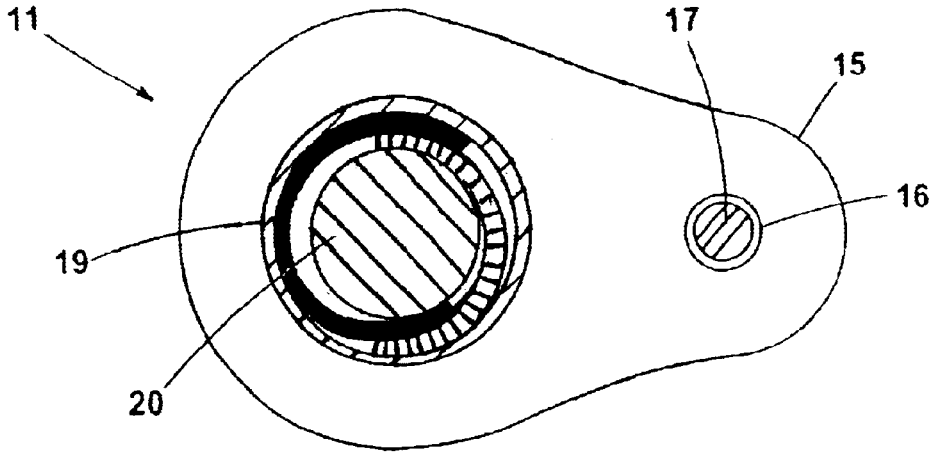
FIG. 3 is a top view of the rotator of FIG. 2.
Figure 2:
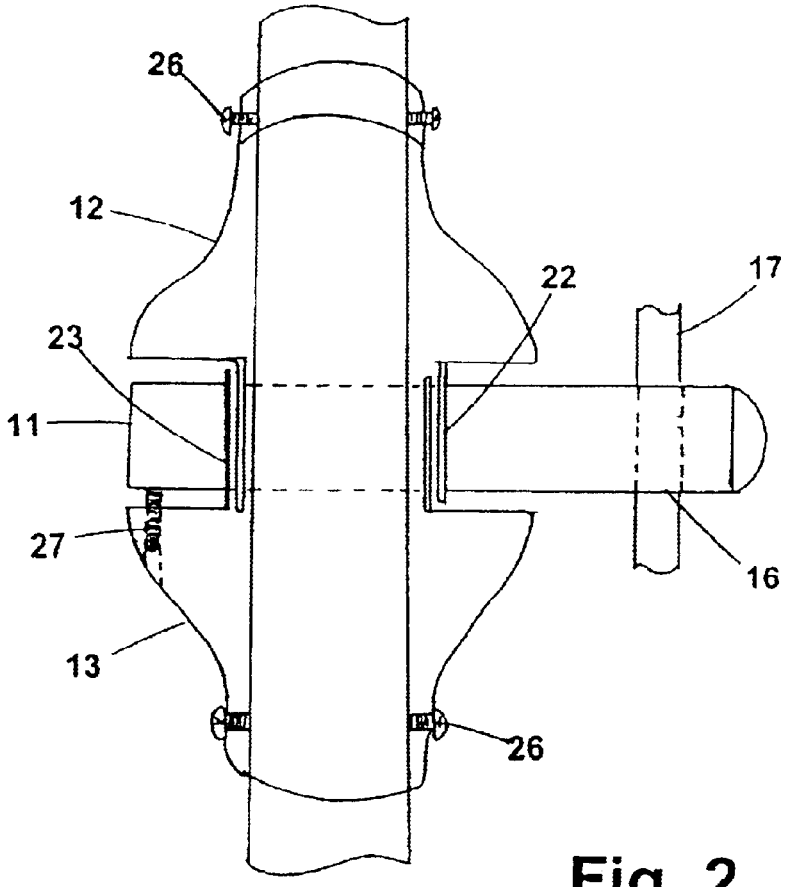
FIG. 2 is an elevation view of the device of the present including a rotator and stabilizer.

With reference now to the drawings, and in particular, to FIGS. 1–3 thereof, a new and improved flagpole mounting device, embodying the principles and concepts of the present invention. Specifically the invention includes a flag mounting device generally designated by the reference number 10, and will be described herein.

It is to be noted in FIGS. 1–3 that to properly maintain a flag 14 on a flagpole 20 requires a pair of the devices 10. Each device 10 comprises several components that collectively work to provide a new and improved flagpole rotation, wherein a flag 14 is free to rotate around a flagpole 20 following the wind direction without unwanted furling. In its broadest context, each device 10 may be comprised of a rotator 11, an upper stabilizer 12 and a lower stabilizer 13. The stabilizers 12 and 13 are removably connected to the flagpole 20 and serve to support and provide a seat for the rotator 11. The flagpole 20 is normally round, but could be of other shapes that could require manufacturing changes, but within the scope and principles of the invention. The flagpole 20 is normally made of aluminum, wood or fiberglass, however the material of the flagpole 20 is not an important variable for the operation of the present invention.

The rotator 11 is capable of being rotated freely through 360° and has means for connecting the flag 14 to the flagpole 20. An extended portion 15 of the rotator 11 has a rod opening 16 defined therein for receiving a rod 17. For flags having a built-in sleeve 18 (see FIG. 4) the rod 17 extends through the sleeve 18, wherein it is attached to the flag 14 to provide strength as well as to assist the flag 14 to maintain a natural and attractive display appearance. The rotator 11 includes an aperture 19, generally in the center of it, for the passage of the flagpole 20 and partially circular flanges, a first flange 22 that is part of the first stabilizer 12, and a second flange 23, which extends from the second stabilizer 13. The flanges 22 and 23 are adapted to isolate the rotator 11 from contact with the flagpole 20, whereby the rotator 11 rotates freely about the flanges 22 and 23. Both stabilizers 12 and 13 may include screws 26 that can be hand tightened to secure and maintain their position on the flagpole 20. The lower stabilizer 13 also may include a countersunk rotation resistance screw 27 that is provided for controlling the degree and speed of rotation.

The extended portion 15 of the rotator 11 serves as a point of contact to the rod 17, which can be either fixed or adjustable. The rod 17 inherently provides a measure of weight that helps keep the flag flying in proper fashion. The rod 17 may be adjustable for small flags and short flagpoles. The fixed length rod would be preferred for larger flags because of the necessary knowledge of what stresses would be incurred for various size flags. Rods 17 can be steel, aluminum, wood, or other materials conducive to the purpose. FIG. 1 shows the use of two rotation devices 10 but it is appreciated that additional units can be used, more preferably in the center, in the case of a very large flag. The rod 17 not only supports the flag 14, but maintains its path of rotation about the pole without deflection.

Figure 5:
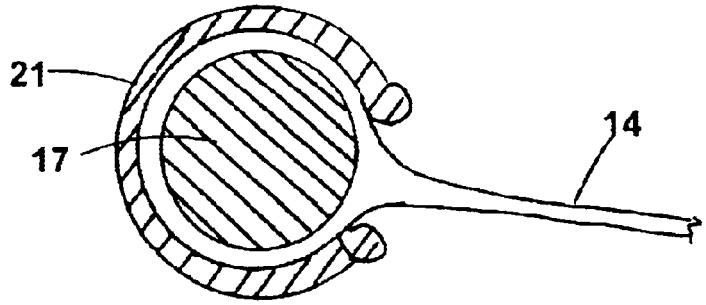
FIG. 5 is a top view of the invention as disclosed in FIG. 4.
Figure 4:
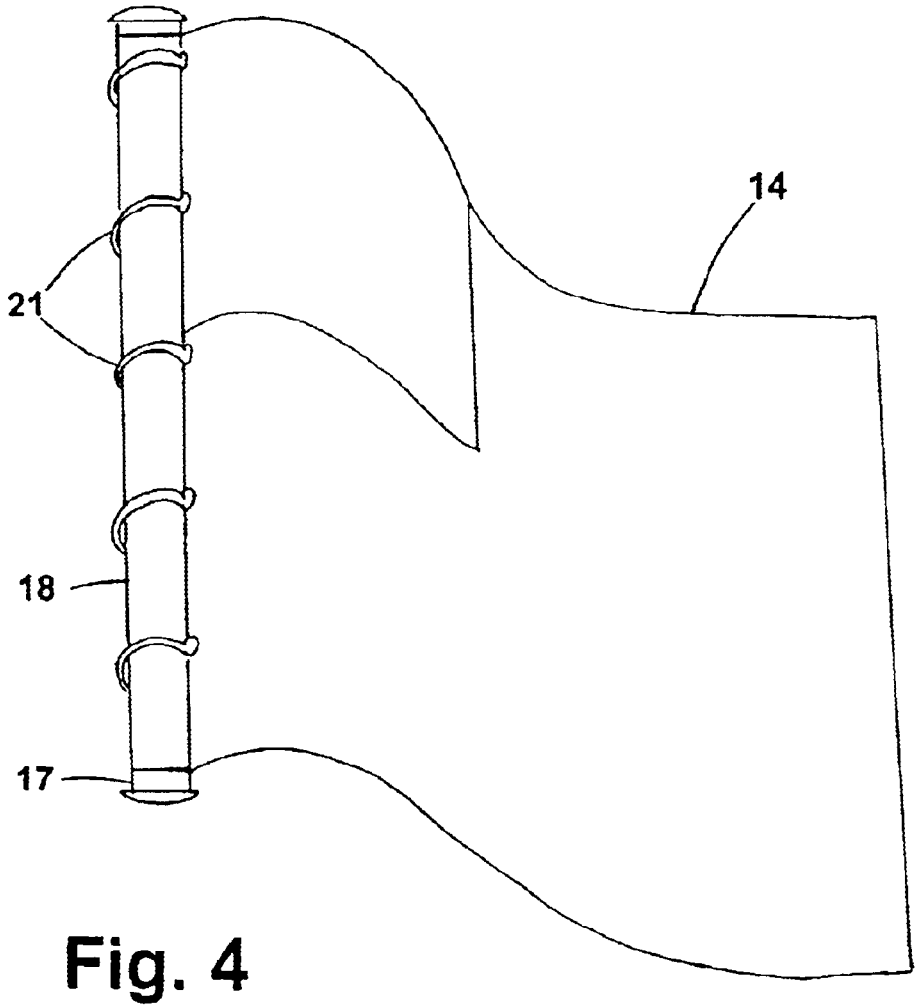
FIG. 4 is a front elevation view of a flag having a hollow sleeve for mounting on a rod with a plurality of clips maintaining the flag in a non-sagging posterior.

The flag 14 may have additional securing means such as that shown in FIGS. 4 and 5, wherein a plurality of clips 21 are illustrated. These clips 21 provide a measure of control as well as to prevent the flag 14 from sagging. It is to be appreciated that the rotators 11 may have a plurality of rod openings 16 wherein a plurality of flags may be supported and flown. Also, the rotator 11 could be affixed with friction free casters in lieu of the invention presented above, but the increased cost would be substantial.

Figure 6:
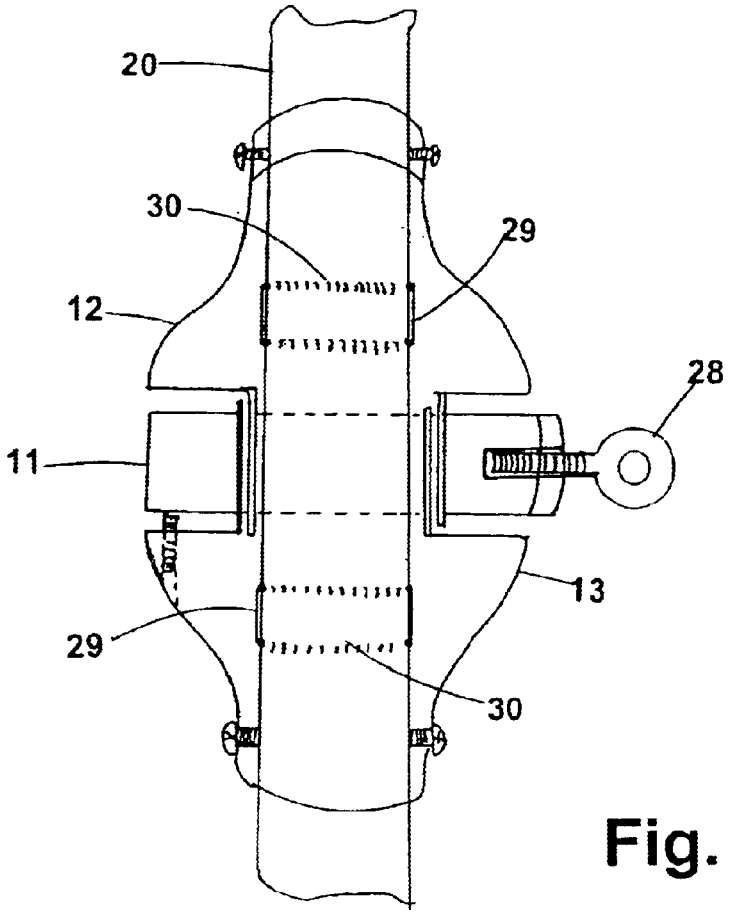
FIG. 6 is a front elevation view of an alternate embodiment of the rotator and stabilizer device.

FIG. 6 describes an alternative embodiment, whereby the extended portion 15 of the rotator 11 includes a bolt 28 attached therein. The bolt 28 may accommodate flags that do not have a sleeve 18 but which could accommodate a rod 17 and be used in conjunction with hooks, loops and other means for fastening the flag 14. Also shown in FIG. 6, are a pair of friction locks 29 that may firmly affix the stabilizers 12 and 13 to recesses 30 that are defined in the flagpole 20

Figure 7:
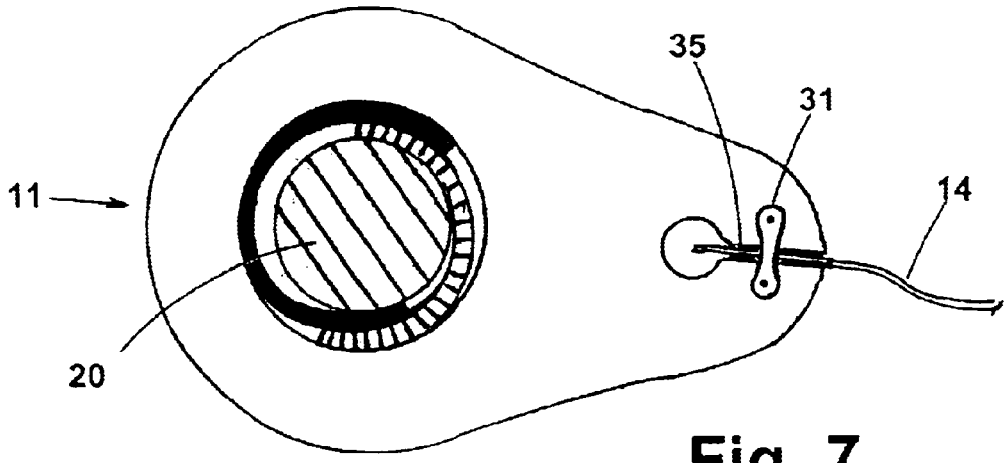
FIG. 7 is a top view of a rotator of an embodiment of the present invention wherein the flag is fastened by a friction-fit to a slit in the rotator.

An embodiment depicted in FIG. 7, attaches a flag 14 by friction fitting within a slit 35 and securing with a clamp 31. This would be especially advantageous for affixing flags that neither have holes for attaching hooks or loops to aid in their attachment to the flagpole, nor have a sleeve 18 in which a rod 17 can run through.

Figure 8:
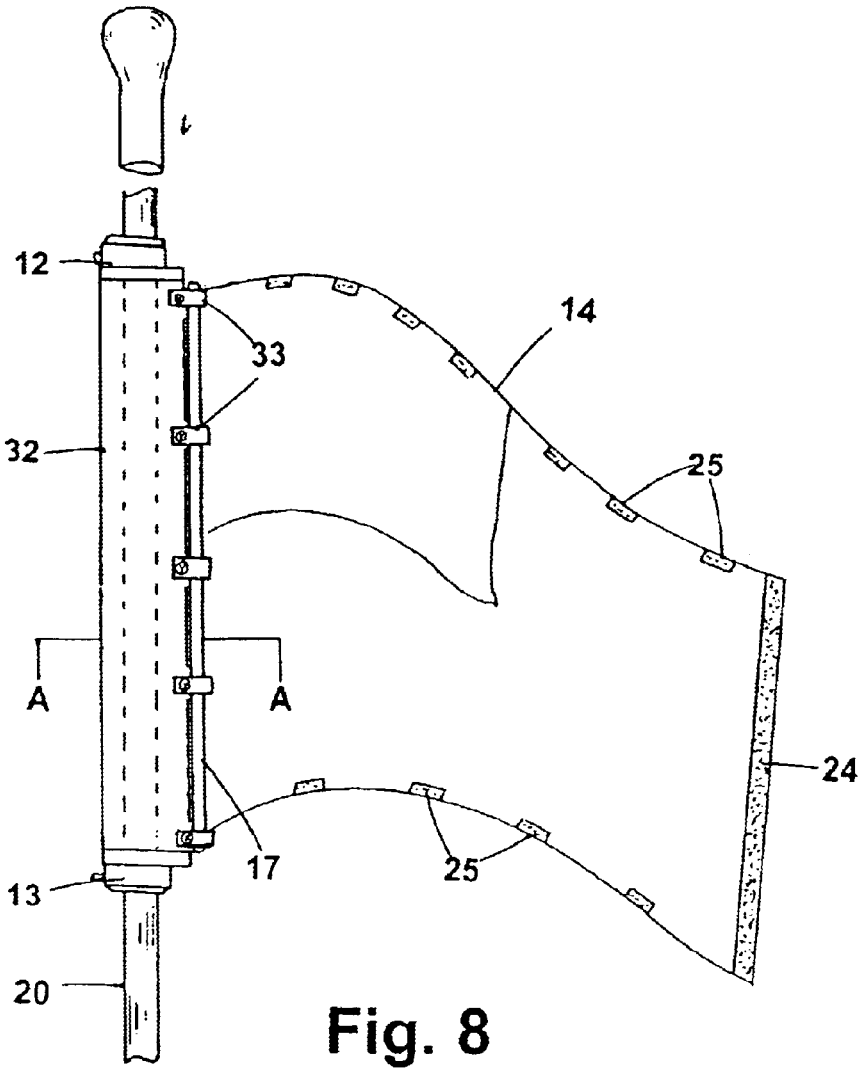
FIG. 8 is an elevated front view of a sleeveless flag mounted to the rotator by brackets.
Figure 9:
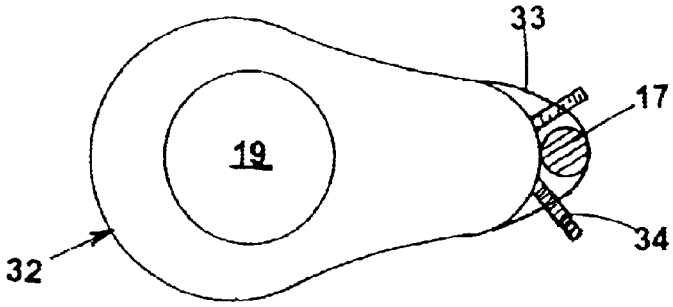
FIG. 9 is a top view along line A—A of the bracket of FIG. 8.

In FIGS. 8 and 9, an embodiment is shown for affixing a flag 14 that has a rod 17 passing through holes in the flag 14 and a one-piece rotator 32 without a rod opening 16 in the extended portion 15. In this embodiment, a plurality of snaps 33 are used to attach the flag 14 to the extended portion 15, by embracing the rod 17 and firmly holding it in place. The plurality of snaps 33 each have a pair of tightening members 34 to hold the snaps 33 in position. FIG. 9 is a top view of the one-piece rotator 32 as shown along line A—A.

Shown in FIG. 1 are plastic strips, a continuous strip 24 and segmented pieces 25. These strips 24 and 25 not only add weight that helps avoid furling, but they also keep the flag in a proper flying position.

Since numerous modification and changes will readily occur to those skilled in the art, it is not desired to limit the invention to the exact construction and operation shown and described, and accordingly, all suitable modification and equivalents may be resorted to, falling within the scope of the invention.

I claim:

1. A flag mounting device to prevent furling of a flag around a flagpole, the device comprising:

a rotator having an aperture defined therein for through passage of the flagpole, the rotator having means for holding the flag;

an upper stabilizer and a lower stabilizer, each positioned on an opposing side of the rotator, the stabilizers having means for positioning and supporting the rotator on the flagpole;

the upper stabilizer having a first partially circular flange extending downwards through the aperture of the rotator and the upper stabilizer encircling the flagpole therein;

the lower stabilizer having a second partially circular flange extending upwards through the aperture of the rotator and the second flange partially encircling the first flange in a generally frictionless relationship, and wherein the rotator may freely rotate 360 degrees about the flagpole.

2. The device according to claim 1, wherein the means for holding the flag to the rotator comprises:

the rotator having an extended portion therein, the extended portion having a rod opening for receiving an opposing end of a rod, and the flag mounted to the rod.

3. The device according to claim 1, wherein the positioning and supporting means of the stabilizers include screws that may be hand tightened to secure and maintain their position on the flagpole.

4. The device according to claim 1, wherein the positioning and supporting means of the stabilizers include friction locks that firmly affix the stabilizers to recesses defined in the flagpole.

5. The device according to claim 1, wherein the rotator further includes a friction-fitting slit secured by a clamp for affixing flags without use of a rod.

6. The device according to claim 1, wherein the flag further includes continuous and segmented plastic strips for adding weight to the flag to avoid furling and maintain the flag in a proper flying position.

7. The device according to claim 1, wherein the device comprises a plurality of rotators.

* * * * *